US008727189B2

(12) United States Patent
Zieman et al.

(10) Patent No.: US 8,727,189 B2
(45) Date of Patent: May 20, 2014

(54) PIN HOLDER WEARABLE AT THE WRIST

(71) Applicant: Clover Mfg. Co., Ltd., Osaka (JP)

(72) Inventors: Nancy L. Zieman, Beaver Dam, WI (US); Chihiro Iwasaki, Osaka (JP)

(73) Assignee: Clover MFG. Co., Ltd., Osaka (JP)

( * ) Notice: Subject to any disclaimer, the term of this patent is extended or adjusted under 35 U.S.C. 154(b) by 0 days.

(21) Appl. No.: 13/756,023

(22) Filed: Jan. 31, 2013

(65) Prior Publication Data

US 2014/0069967 A1 Mar. 13, 2014

(30) Foreign Application Priority Data

Sep. 7, 2012 (JP) ..... 2012-197716

(51) Int. Cl.
*H01F 7/02* (2006.01)
*A45F 5/00* (2006.01)

(52) U.S. Cl.
USPC ..... 223/109 A; 224/183

(58) Field of Classification Search
USPC ..... 223/106–109 A; 224/164, 183, 218, 219
See application file for complete search history.

(56) References Cited

U.S. PATENT DOCUMENTS

| | | | | | |
|---|---|---|---|---|---|
| 2,176,052 | A * | 10/1939 | Beyer | 132/331 |
| 5,196,818 | A * | 3/1993 | Anderson | 335/285 |
| 5,201,444 | A * | 4/1993 | Simonet | 224/183 |
| 5,738,398 | A * | 4/1998 | Miano | 294/166 |
| 7,347,019 | B1 * | 3/2008 | Shaw | 40/607.01 |
| 2003/0155389 | A1 * | 8/2003 | Swartzentruber | 224/164 |
| 2009/0050657 | A1 * | 2/2009 | Woolery | 224/183 |

FOREIGN PATENT DOCUMENTS

| | | |
|---|---|---|
| JP | 35-7552 | 4/1960 |
| JP | 3043144 | 8/1997 |
| JP | 3101736 | 3/2004 |

* cited by examiner

*Primary Examiner* — Ismael Izaguirre
(74) *Attorney, Agent, or Firm* — Hamre, Schumann, Mueller & Larson, P.C.

(57) ABSTRACT

The pin holder wearable at the wrist includes a main body and a band supporting the main body and being wearable at the user's wrist. The main body includes permanent magnets and a casing. The casing accommodates the permanent magnets and has attraction surfaces at the top portion. The attraction surfaces serve to attract and hold needlecraft pins by the magnet force of the permanent magnet. The band is in the shape of a strip as a whole, and can change into the first form that the band is stretched straight or the second form that the band curves in the longitudinal direction to form a ring. The main body is relatively movable with relation to the band with a predetermined friction resistance.

6 Claims, 12 Drawing Sheets

PIN HOLDER WEARABLE AT THE WRIST

BACKGROUND OF THE INVENTION

1. Field of the Invention

The present invention relates to a tool that holds pins for needlecrafts or the like such as sewing needles and marking pins, and specifically relates to a pin holder configured to be wearable at the wrist.

2. Description of the Related Art

When needlecraft pins, including sewing needles and marking pins, are not in use, they are generally held at e.g. a pin holding cushion which pins are stuck into. As a substitute for a pin holding cushion, a pin holder has been proposed that is configured to attract and hold needle craft pins with a built-in magnet, as described in Patent Document 1 below. Such a magnet-type pin holder is capable of collecting together and holding tightly needlecraft pins made of metal.

A pin holder configured to be wearable at the arm (the wrist in particular) of the user at needlework is also known, as described in Patent Document 2 below. This document discloses in FIG. 9 a wrist-worn pin holder that includes a band windable around the wrist and a main body mounted on the band. The main body includes a hemispheric cushion. When the wrist-worn pin holder is in use, the user can sting a plurality of needlecraft pins into the cushion of the main body to hold the pins, and pull out the pins from the cushion to use them. With such a wrist-worn pin holder, the user can handle needlecraft pins in an area close to the user's hands.

However, the writs-worn pin holder disclosed in Patent Document 2 below is uneasy to handle in attaching a pin to the main body and taking a pin from the main body when a lot of pins are involved, and therefore have room for improvement.

Patent Document 1: JP-U-3101736

Patent Document 2: JP-U-3043144

SUMMARY OF THE INVENTION

The present invention has been conceived under the above-described circumstances. It is therefore an object of the present invention to provide a pin holders wearable at the wrist that is easy to use.

To solve the above-described problems, the present invention employs technical measures described below.

A pin holder wearable at a wrist according to the present invention comprises a main body; and a band supporting the main body; the main body comprising a permanent magnet body and a casing, the casing accommodating the permanent magnet body, the casing having an attraction face at a top portion, the attraction face being configured to attract and hold a needlecraft pin by means of a magnet force produced by the permanent magnet body, the casing being supported at a bottom portion by the band, the band being in a shape of a strip as a whole, the band being configured to be in a first form that the band extends straight or a second form that the band forms a ring by curving in a longitudinal direction of the band, the band being capable of retaining the first form or the second form, the main body being relatively movable with relation to the band in the first form with a predetermined friction resistance.

Preferably, the permanent magnet body comprises a first permanent magnet and a second permanent magnet, the first permanent magnet and the second permanent magnet being spaced from each other in a second direction perpendicular to a first direction, the first direction orienting from the bottom portion to the top portion, the attraction face comprising a first attraction surface and a second attraction surface, the first attraction surface and the second attraction surface being located correspondingly to the first permanent magnet and the second permanent magnet, respectively, a recess being provided between the first attraction surface and the second attraction surface on the top portion, the recess extending in a third direction perpendicular to both of the first direction and the second direction.

Preferably, a polarity of a pole of the first permanent magnet facing the first attraction surface is opposite to a polarity of a pole of the second permanent magnet facing the second attraction surface.

Preferably, the third direction is a longitudinal direction of the band.

Preferably, the band comprises a flexible plate formed in a shape of a strip, the flexible plate having a first spring function, the first spring function causing the flexible plate to curve in a longitudinal direction of the flexible plate so as to move both ends of the flexible plate close to each other thereby forming a ring as a whole, the flexible plate having a second spring function, the second spring function causing the flexible plate to curve in a width direction of the flexible plate so as to hollow one side of the flexible plate thereby retaining the flexible plate in a straight shape when the flexible plate is stretched straight restraining the first spring function, the one side being configured to be an outer surface when the flexible plate curves in the longitudinal direction of the flexible plate.

Preferably, the flexible plate comprises a spring steel plate, a surface of the flexible plate being covered with a cover having flexibility.

Preferably, the bottom portion of the casing is provided with a support plate, the support plate being spaced away from the bottom portion by a predetermined gap, the main body being configured to be supported by the band by inserting the band into between the support plate and the bottom portion, a dimension in a height direction of the band in the first form being greater than a distance between the support plate and the bottom portion, the height direction being perpendicular to both of a longitudinal direction and a width direction of the band.

Other features and advantages the present invention become clearer from the detailed description given below with reference to the accompanying drawings.

DETAILED DESCRIPTION OF THE PREFERRED EMBODIMENTS

Figure 1:
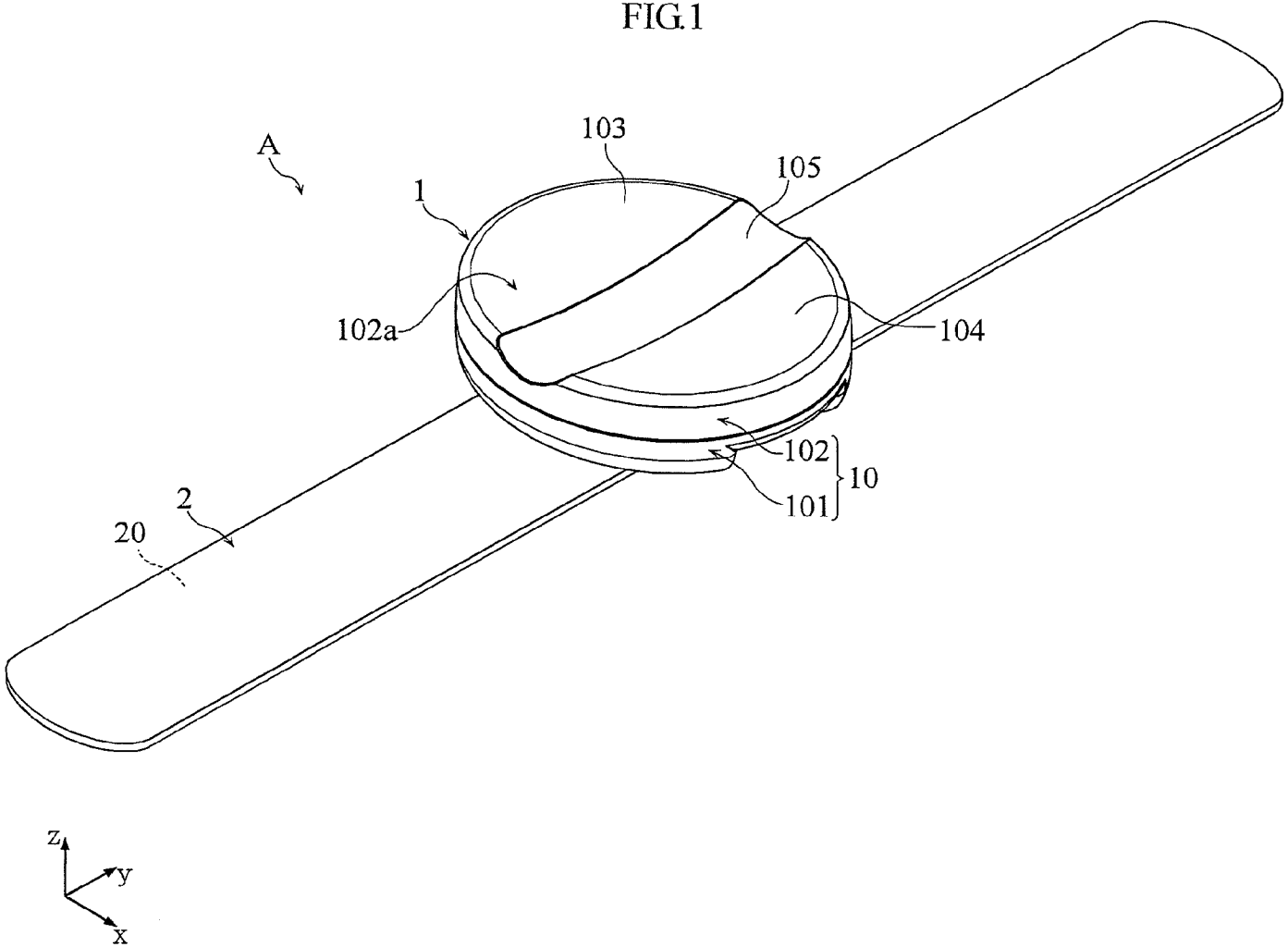
FIG. 1 is a perspective view showing an example of a pin holder wearable at the wrist according to the present invention.

A preferred embodiment of the present invention is described below with reference to the accompanying drawings.

FIGS. 1-7 show an embodiment of a pin holder wearable at the wrist according to the present invention. In this embodiment, the pin holder wearable at the wrist A includes a main body 1 and a band 2 supporting the main body 1.

The main body 1 includes a casing 10, a magnetic member 11, and two permanent magnets 12, 13. The permanent magnets 12, 13 serve to attract and hold needlecraft pins such as sewing needles and marking pins by means of magnetic force. The casing 10 is a hollow body including a lower casing member 101 and an upper casing member 102, and provides accommodation for the magnetic member 11 and the permanent magnets 12, 13.

The casing 10 (i.e. the lower casing member 101 and the upper casing member 102) is made of synthetic resin having predetermined strength, such as ABS (acrylonitrile butadiene styrene) resin. The lower casing member 101 and the upper casing member 102 are attached to each other integrally by means of ultrasonic welding or adhesive, for example. In this embodiment, the casing 10 is substantially elliptical as plan-viewed (The major axis of the ellipse is oriented along x-direction whereas the minor axis extends along y-direction in FIGS. 1-3.). For example, the lengths of the major and minor axes of the ellipse can be about 57 mm and 51 mm, respectively.

Figure 2:
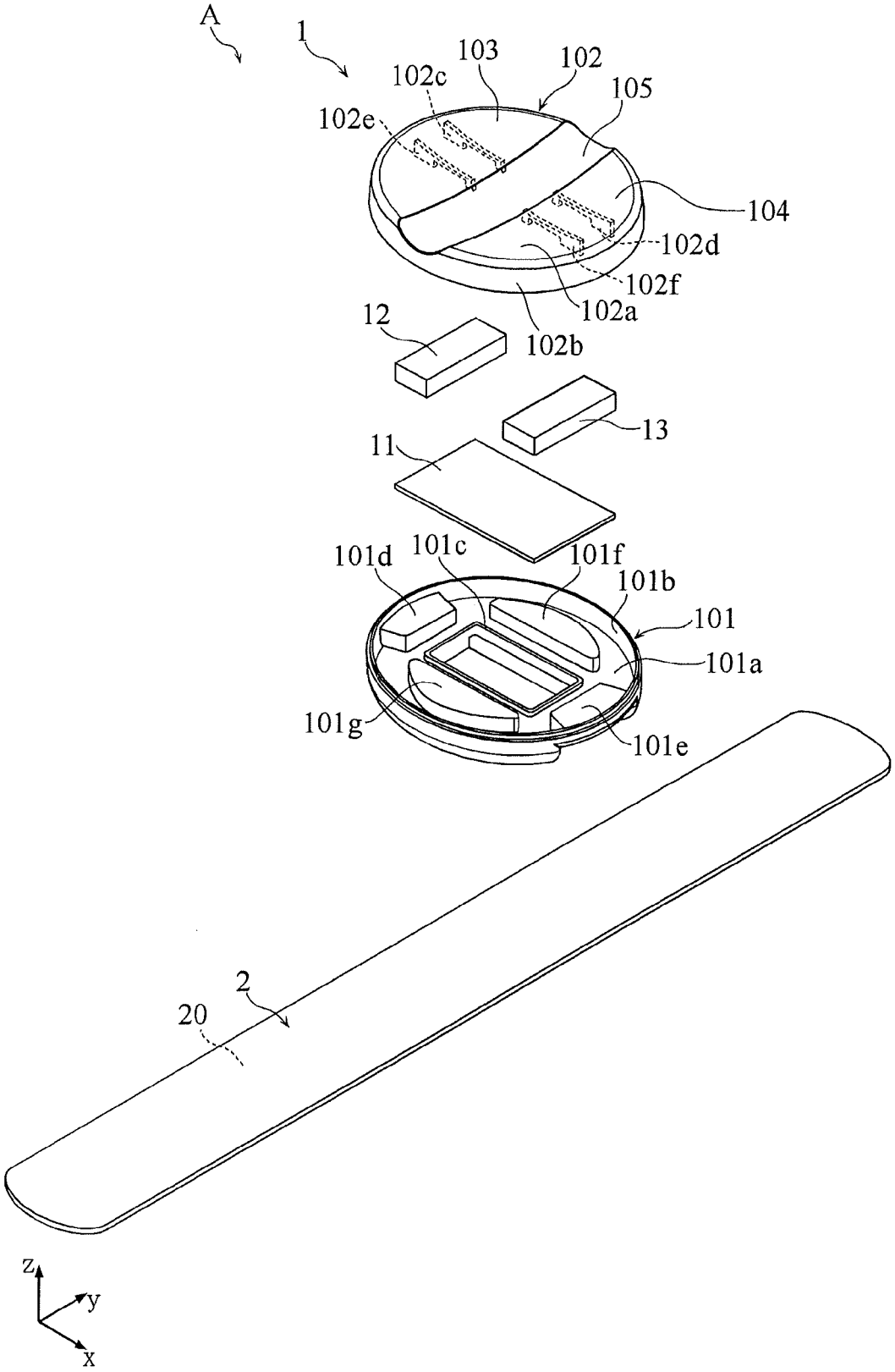
FIG. 2 is an exploded perspective view showing the pin holder wearable at the wrist shown in FIG. 1.

As shown in FIG. 2, the lower casing member 101 includes a bottom portion 101*a* which is elliptical as plan-viewed, a peripheral wall 101*b* which extends upward from the edge of the bottom portion 101*a*, and projections 101*c*, 101*d*, 101*e*, 101*f*, and 101*g* which project upward from the bottom portion 101*a* inside the peripheral wall 101*b*. The height of the projection 101*c* is different from the height of the other projections 101*d*, 101*e*, 101*f*, and 101*g*. The projection 101*c*, which is formed as a rectangular frame, serves to support the magnetic member 11 which is laid thereon. The projections 101*d*, 101*e*, 101*f*, and 101*g* serve to position the permanent magnets 12, 13.

The upper casing 102 includes a top portion 102*a* which is elliptical as plan-viewed, a peripheral wall 102*b* which extends downward from the edge of the bottom portion 102*a*, and projections 102*c*, 102*d*, 102*e*, and 102*f* which project downward from the top portion 102*a* inside the peripheral wall 102*b*.

The upper surface of the top portion 102*a* is provided with attraction surfaces 103, 104 which are spaced from each other in x-direction. The locations of the attraction surfaces 103, 104 correspond to the permanent magnets 12, 13, respectively. The attraction surfaces 103, 104 overlap the permanent magnet 12, 13 in the height direction of the main body 1 (i.e. z-direction which extends from the bottom portion 101*a* towards the top portion 102*a*), respectively. In this embodiment, x-direction and z-direction are perpendicular to each other.

Figure 6:
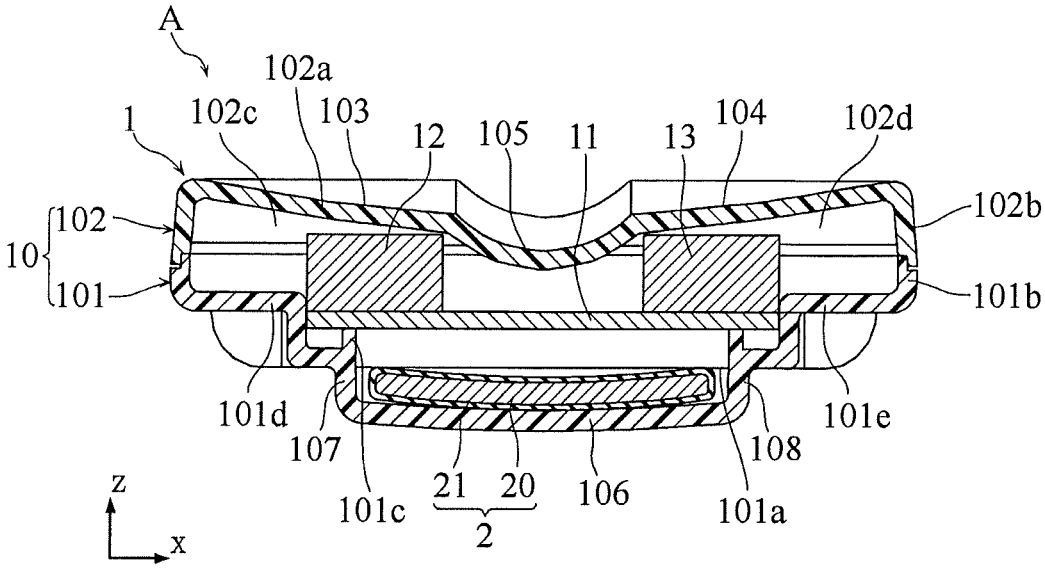
FIG. 6 is an enlarged sectional view taken along line VI-VI in FIG. 3.
Figure 7:
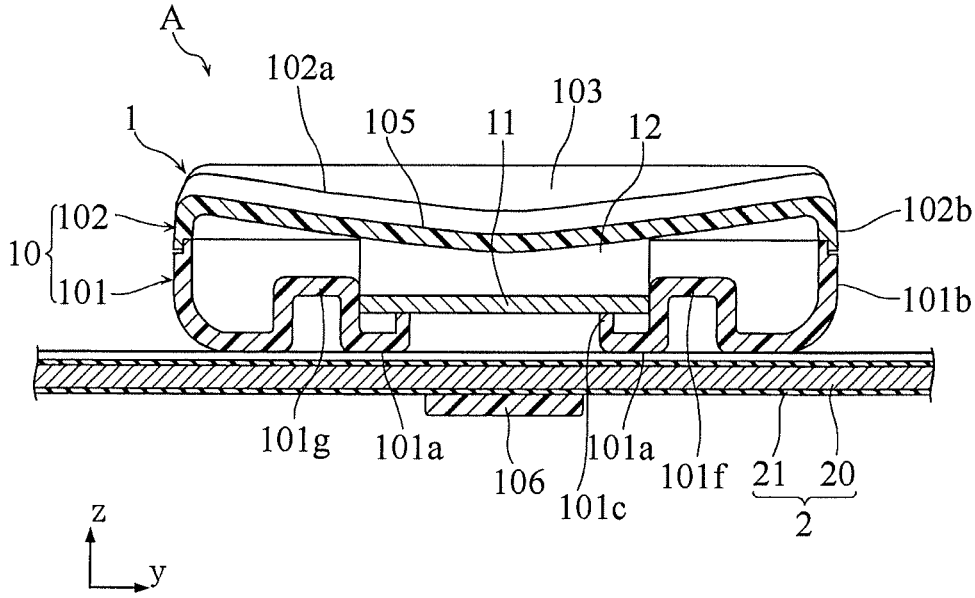
FIG. 7 is an enlarged sectional view of the substantial part taken along line VII-VII in FIG. 4.
Figure 8:
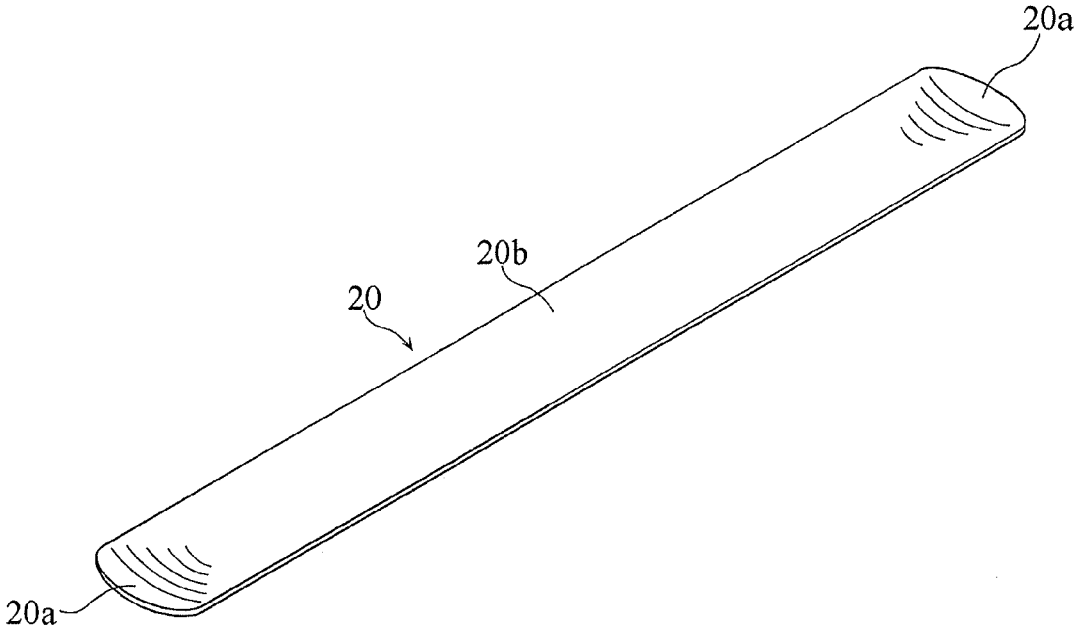
FIG. 8 is a perspective view showing a flexible plate serving as a band.

A recess 105 extending in y-direction (i.e. the direction perpendicular to both of z-direction and x-direction) is formed between the attraction surfaces 103, 104 of the top portion 102*a*. As shown in FIGS. 1 and 6, in this embodiment, the recess 105 has a substantially circular arc-shaped cross section and extends in y-direction over the whole length of the top portion 102. The cross section of the recess 105 is not limited to a circular arc shape but can be a variety of shapes.

The casing 10 is supported by the band 2 at the bottom portion 101*a* of the lower casing member 101. The bottom portion 101*a* is provided with a support plate 106. The support plate 106 is connected with the tips of pendent plates 107, 108, which extend downward from the bottom portion 101*a* and spaced from each other so as to form a predetermined gap between the support plate 106 and the bottom portion 101*a*. As shown in FIGS. 4-7, the band 2 is inserted into between the support plate 106 and the bottom portion 101*a* so that the band 2 can support the casing 10 (the main body 1), as will be described later.

The magnetic member 11 serves to prevent the magnetic field produced by the permanent magnets 12, 13 laid on the upper surface of the magnetic member 11 from spreading downward. The magnetic member 11 is rectangular as plan-viewed and made of a ferromagnetic material such as iron or iron alloy. The magnetic member 11 may be made of a ferromagnetic material other than iron.

The permanent magnets 12, 13 are laid on the upper surface of the magnetic member 11 and spaced from each other in x-direction. The permanent magnets 12, 13 are e.g. in the shape of a relatively flat quadratic prism and made of e.g. ferrite magnet. The permanent magnets 12, 13 are positioned by the projections 101*d*-101*g* and 102*c*-102*f* in the casing 10.

In this embodiment, the two permanent magnets 12, 13 are arranged in a manner such that the polarity of the upper surface of the permanent magnet 12 facing the attraction surface 103 is different from the polarity of the upper surface of the permanent magnet 13 facing the attraction surface 104 (i.e. N-pole and S-pole). This arrangement concentrates magnetic field lines connecting both of the magnetic poles on the area above and between the permanent magnets 12, 13.

The band 2 includes a flexible plate 20 in the shape of strip and a cover 21 which covers surfaces of the flexible plate 20, and is in the shape of strip as a whole. The cover 21 is made of a flexible material such as rubber and soft resin. Such a flexible material is required to be elastically deformed in accordance with deformation of the flexible plate 20, which will be described below. An example of such a flexible material is silicone rubber. The band 2, i.e. the flexible plate 20 covered by the cover 21, can be obtained by insert molding.

Figure 10:
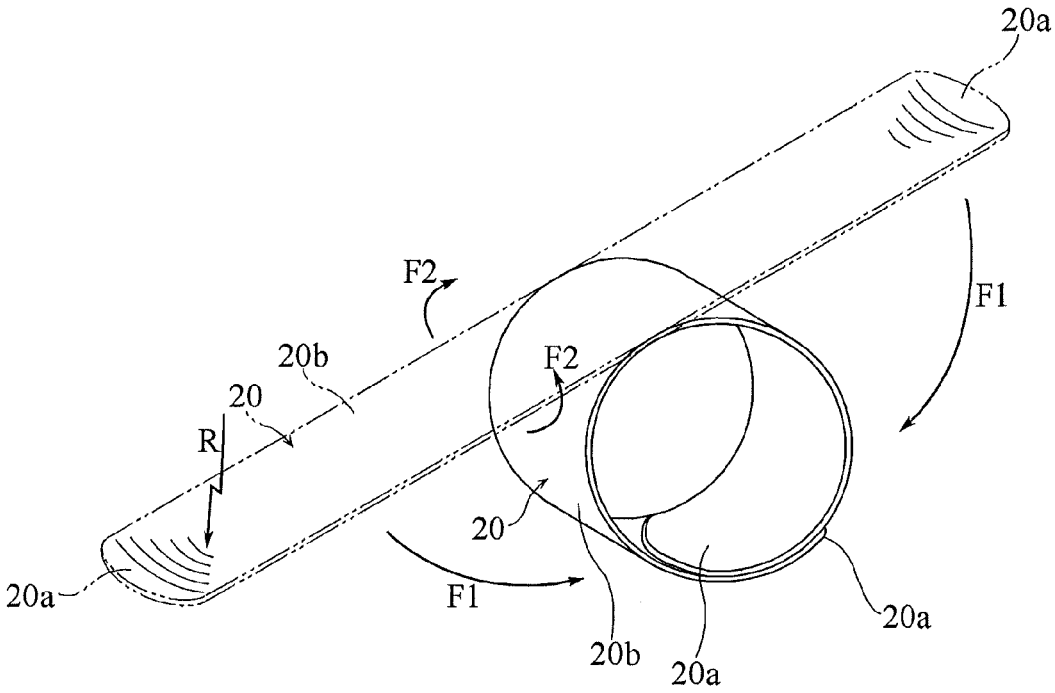
FIG. 10 is a perspective view showing a flexible plate serving as a band in the deformed state.

The flexible plate 20 is a thin spring steel plate. The shape of the flexible plate 20 can be change into the first form, shown in FIGS. 1-8, in which whole the flexible plate 20 extends straight or the second form, shown by the solid lines in FIG. 10, in which both of the edges 20*a*, 20*a* spaced from each other in the longitudinal direction come close to each other by bending the flexible plate 20 so as to form a ring as a whole. Moreover, the flexible plate 20 can retain the first or second form. Specifically, the flexible plate 20 has the first spring function which bends the flexible plate 20 in the longitudinal direction so as to move both of the ends 20*a*, 20*b* spaced from each other in the longitudinal direction closer to each other by exerting an elastic force denoted by F1, F1 in FIG. 10. Moreover, the flexible plate 20 also has the second spring function which bends the flexible plate 20 in width direction in a manner such that one side 20*b* of the flexible plate 20 curves with a predetermined curvature radius R to make a recess as indicated in the dashed lines, by exerting an elastic force denoted by F2, F2 in FIG. 10. The recessed side 20*b* becomes the outer surface when the flexible plate 20 is in the form depicted by the solid lines in FIG. 10.

Figure 9:
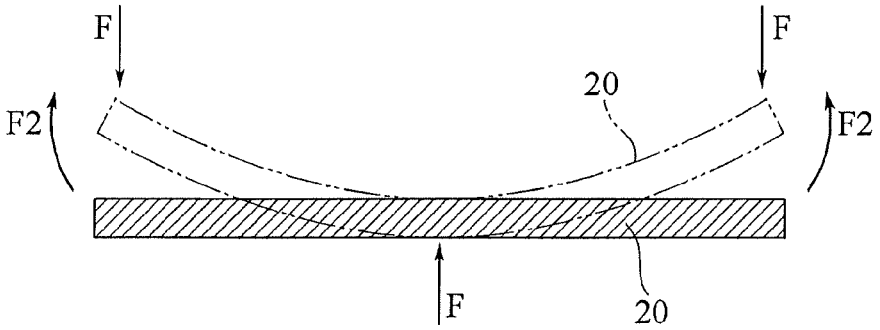
FIG. 9 is an explanatory diagram showing a flexible plate serving as a band in the deformed state.

Having the above-described first spring function and second spring function, the flexible plate 20 can change the shape as follows: when the flexible plate 20 is stretched straight against the elastic force F1, F1, the flexible plate 20 curves in the width direction by the second spring function, which restrains the first spring function, retaining the straight stretched form. On the other hand, when the flexible plate 20 in the straight stretched form is deformed in a manner such that the cross section in the width direction of the flexible plate 20 is uncurved to become straight by pressing parts of the flexible plate 20 curved in the width direction with force F against the elastic force F2, F2 as indicated with the dashed lines in FIG. 9, the flexible plate 20 then curves into a ring shape as a whole by the first spring function and the elastic force F1, F1 as indicated by the solid lines in FIG. 10. In this ring state, the flexible plate 20 does not curve in the width direction. With the flexible plate 20 as the main component, the band 2 can also change the shape into the first form or the second form and retain the form similarly to the flexible plate 20.

In this embodiment, as described above, the main body 1 is supported by the band 2 by inserting the band 2 into between the support plate 106 and the bottom portion 101*a* of the casing (the main body 1). In this way, the main body 1 and the band 2 are attachable to and removable from each other.

Figure 11:
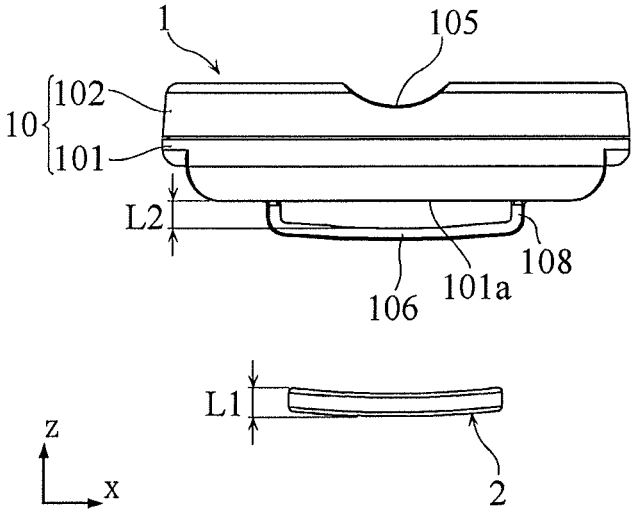
FIG. 11 is an explanatory front view for dimensions of the band in which the main body is separated from the band.

As shown in FIG. 11, when the band 2 is in the first form in which whole the flexible plate 20 extends straight, the dimension L1 in the height direction, which is perpendicular to both of the longitudinal direction and the width direction of the band 2, is slightly larger than the dimension L2 between the support plate 106 and the bottom portion 101*a*.

When the band 2 is inserted into between the support plate 106 and the bottom portion 101*a*, the flexible plate 20 in the band 2 is slightly deformed so as to slightly flatten the curve in the width direction of the flexible plate 20 because the support plate 106 and the bottom portion 101*a* get contact with and press the cover 21. In this case, the second spring function which bends the flexible plate 20 in the width direction works. Therefore, when the main body is supported by the band 2, the band 2 retains in the first form in which whole the band 2 extends straight whereas the main body 1 is relatively movable with relation to the band 2 with a predetermined frictional resistance.

Figure 3:
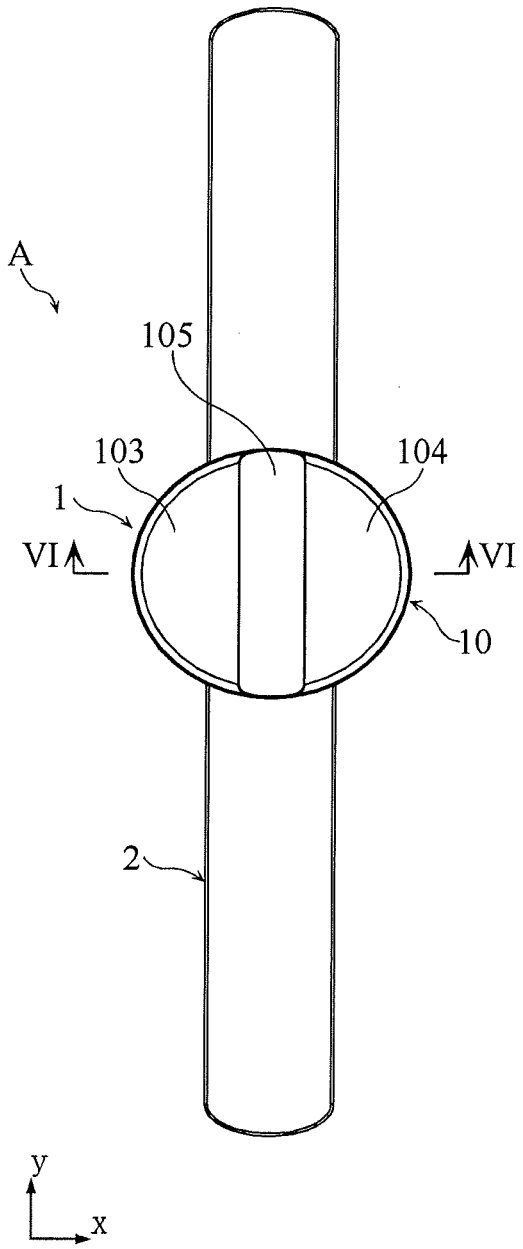
FIG. 3 is a plan view showing the pin holder wearable at the wrist shown in FIG. 1.
Figure 4:
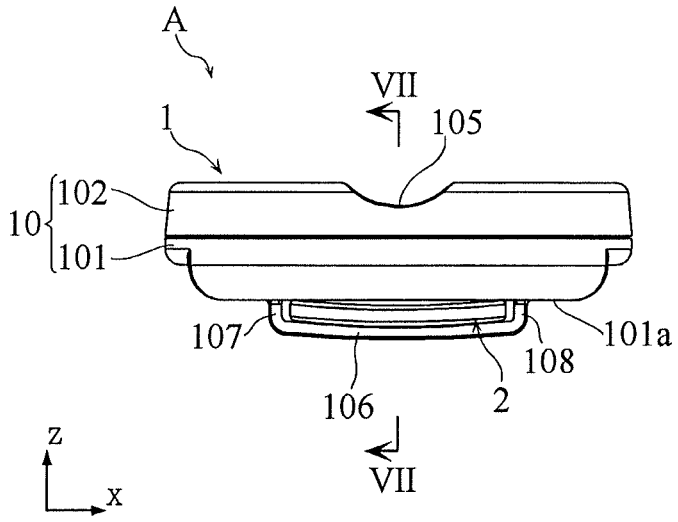
FIG. 4 is a front view showing the pin holder wearable at the wrist shown in FIG. 1.
Figure 5:
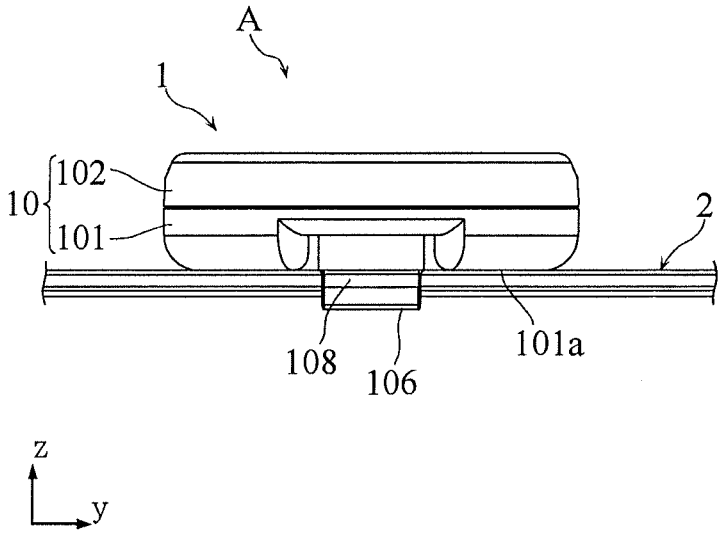
FIG. 5 is a partial side view showing the pin holder wearable at the wrist shown in FIG. 1.

As shown in FIGS. 1 and 3, in this embodiment, the recess 105 of the main body 1 extends along y-direction, which is also the longitudinal direction of the band 2 when the main body 1 is supported by the band 2.

Next, use and advantage of the pin holder wearable at the wrist A with the above-describe configuration are described below with reference to FIGS. 12-15.

Figure 12:
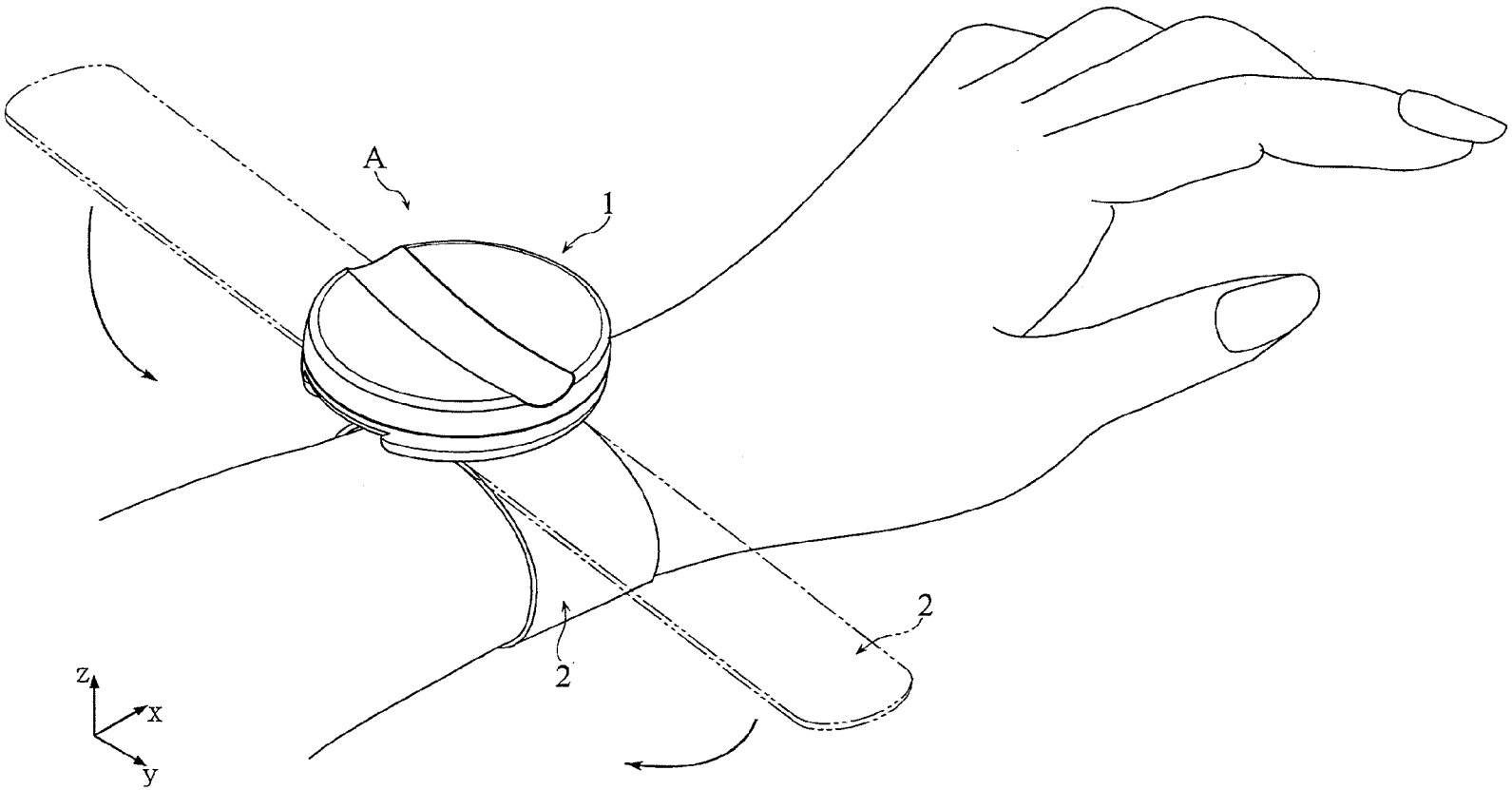
FIG. 12 is a perspective view showing the pin holder wearable at the wrist shown in FIG. 1 in use.
Figure 13:
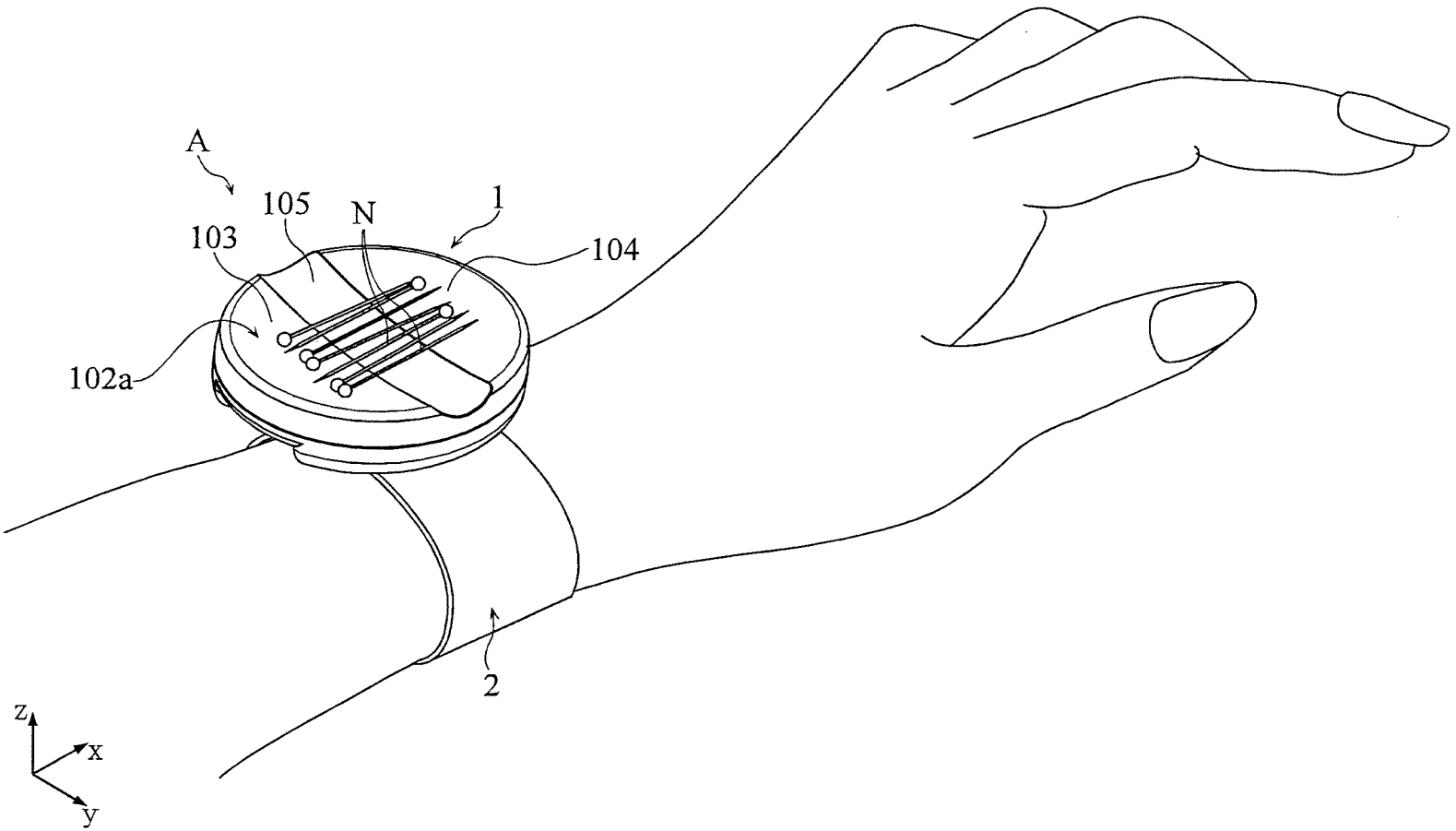
FIG. 13 is a perspective view showing the pin holder wearable at the wrist shown in FIG. 1 in use.
Figure 14:
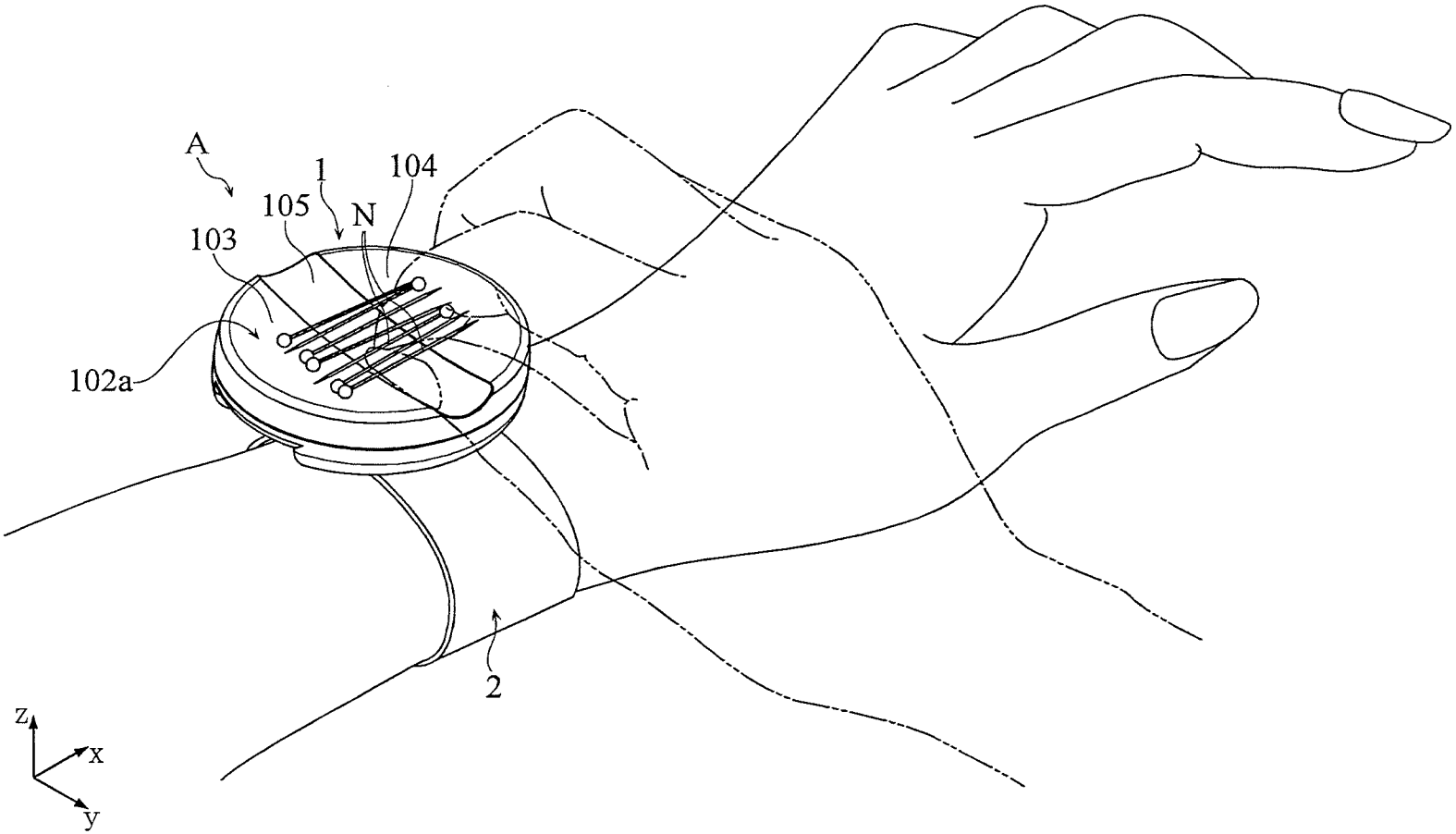
FIG. 14 is a perspective view showing the pin holder wearable at the wrist shown in FIG. 1 in use.

When the pin holder wearable at the wrist A is used, the pin holder wearable at the wrist A is set in the form depicted in FIG. 1, and then the pin holder wearable at the wrist A is put on the user's arm (wrist) as shown in FIG. 12, and after that, part of the band 2 in a straight stretched state is pressed from above. In response to this, the first spring function of the flexible plate 20 works so that the pin holder wearable at the wrist A can be worn at the user's wrist. In this way, the user can easily wear the pin holder wearable at the wrist A in only one move.

By simply putting needlecraft pins (hereinafter, referred to as pins N) on the top portion 102*a* of the main body 1, the pins N are attracted to and held on the attraction surfaces 103, 104 by means of a magnetic force produced by the permanent magnets 12, 13 housed in the main body 1. Therefore, the pin holder wearable at the wrist A is easy to use because the user can wear it at the wrist in one move and pins N are quickly held on it. In particular, in the case of holding a multiple of pins N (marker pins) on the pin holder wearable at the wrist A, the user does not need to sting pins into a cushion, which is advantageous.

The pole of the permanent magnet 12 facing the attraction surface 103 is opposite to the pole of the permanent magnet 13 facing the attraction surface 104. With such a configuration, pins N are held in substantially parallel with the line connecting the two permanent magnets 12, 13 so as to straddle the attraction surfaces 103, 104 by magnetic field lines produced by the permanent magnets 12, 13. A recess 105 is formed between the attraction surfaces 103, 104. The recess 105 extends along y-direction perpendicular to x-direction, in which the attraction surfaces 103, 104 are spaced from each other. Therefore, pins N are attracted and held so as to cross the recess 105 without being oriented toward irregular directions.

Because the permanent magnets 12, 13 are laid on the upper surface of the magnetic member 11, the magnetic fields produced by the permanent magnets 12, 13 are prevented from spreading downward. Therefore, pins are not attracted to and held at unintended portion such as the bottom portion 101*a* of the main body 1. Further, since the magnetic fields are prevented from spreading downward from the permanent magnets 12, 13, magnetic field lines are concentrated on the area above and between the upper surfaces of the permanent magnets 12, 13, i.e. the magnetic poles. Therefore, pins N are held firmly on the attraction surfaces 103, 104.

With above-described configuration, a gap is made between the pins N attracted to the main body 1 and the recess 105. Therefore, as indicated by the dashed lines in FIG. 14, the user can easily pick up the pins N with his/her fingers to take the pins N from the attraction surfaces 103, 104, which attracts and holds the pins N. This leads to ease to use.

In the present embodiment, the direction in which the recess 105 extends (i.e. y-direction) is the same as the longitudinal direction of the band 2. Therefore, when the pin holder wearable at the writs A is worn at the user's wrist, the recess 105 extends in a direction substantially perpendicular to the direction in which the user's arm extends. Accordingly, as understood from FIGS. 1-4, it is easy for the user to understand the orientation of the pins N at a glance when the user intends to pick up a held pin N with his/her fingers, and it is also easy for the user to pick up a held pin N by means of natural move of the user's hand. This leads to ease to use the pin holder wearable at the wrist A.

Figure 15:
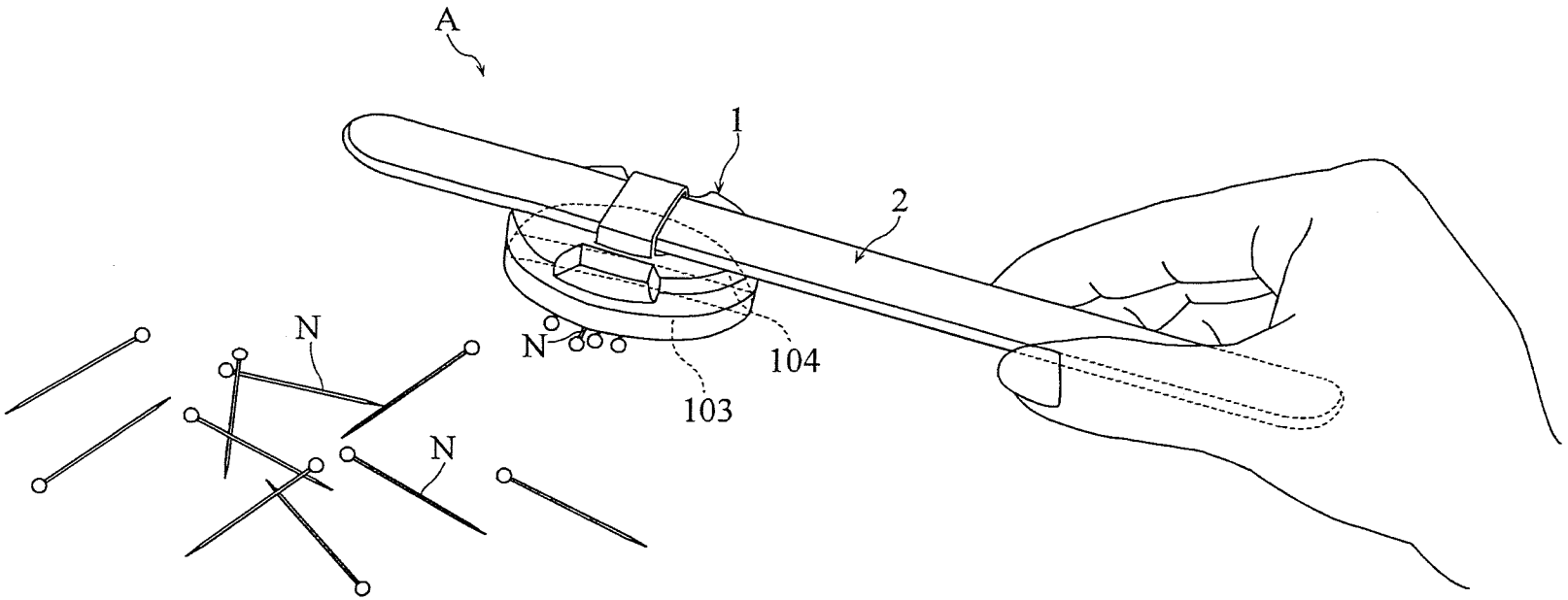
FIG. 15 is a perspective view showing the pin holder wearable at the wrist shown in FIG. 1 in use.

In the pin holder wearable at the wrist A according to the present embodiment, the main body A is movable with relation to the band 2 with predetermined friction resistance. Therefore, the user can use the pin holder A in the following manner: First, the pin holder wearable at the wrist A is put in the form depicted in FIG. 1, without being worn at the user's wrist. At this moment, the band 2 is in the first form in which whole the band 2 is stretched straight. Then, the main body 1 is shifted with relation to the band 2 closer to one end in the longitudinal direction of the band 2. Next, the pin holder wearable at the wrist A is put upside down so that the user can pinch the other end in the longitudinal direction of the band 2. In this way, the attraction surfaces 103, 104 face downward as shown in FIG. 15. Accordingly, by moving the attraction surfaces 103, 104 close to pins N littered on the desk or the like, it is possible to collect the pins N by attracting them to the attraction surfaces 103, 104.

The main body 1 is not easily displaced with relation to the band 2. By locating the main body 1 close to one end of the band 2 as shown in FIG. 15, it is possible to collect efficiently pins N littered in a wide range. With the configuration shown in FIG. 15, it is also possible to insert the main body 1 into a narrow space that the user's hand and arm cannot enter, thereby enabling pins N littered in the narrow space to be collected.

An embodiment of the present invention has been explained. The technical scope of the present invention is not limited to the above-mentioned embodiment. Specific configuration of each parts of the pin holder wearable at the wrist according to the present invention can be varied in many ways unless such a variation deviate from the concept of the presents invention.

The invention claimed is:

1. A pin holder wearable at a wrist, comprising:

a main body; and a band supporting the main body;

the main body comprising a permanent magnet body and a casing, the casing accommodating the permanent magnet body, the casing having an attraction face at a top portion, the attraction face being configured to attract and hold a needlecraft pin by means of a magnet force produced by the permanent magnet body, the casing being supported at a bottom portion by the band, the band being in a shape of a strip as a whole, the band being configured to be in a first form that the band extends straight or a second form that the band forms a ring by curving in a longitudinal direction of the band, the band being capable of retaining the first form or the second form, the main body being relatively movable with relation to the band in the first form with a predetermined friction resistance, the permanent magnet body comprising a first permanent magnet and a second permanent magnet, the first permanent magnet and the second permanent magnet being spaced from each other in a second direction perpendicular to a first direction, the first direction extending from the bottom portion to the top portion, the attraction face comprising a first attraction surface and a second attraction surface, the first attraction surface and the second attraction surface being located correspondingly to the first permanent magnet and the second permanent magnet, respectively, a recess being provided between the first attraction surface and the second attraction surface on the top portion, the recess extending in a third direction perpendicular to both of the first direction and the second direction.

2. The pin holder wearable at the wrist according to claim 1, a polarity of a pole of the first permanent magnet facing the first attraction surface being opposite to a polarity of a pole of the second permanent magnet facing the second attraction surface.

3. The pin holder wearable at the wrist according to claim 2, the third direction being a longitudinal direction of the band.

4. The pin holder wearable at the wrist according to claim 1, the band comprising a flexible plate formed in a shape of a strip, the flexible plate having a first spring function, the first spring function causing the flexible plate to curve in a longitudinal direction of the flexible plate so as to move both ends of the flexible plate close to each other thereby forming a ring as a whole, the flexible plate having a second spring function, the second spring function causing the flexible plate to curve in a width direction of the flexible plate so as to hollow one side of the flexible plate thereby retaining the flexible plate in a straight shape when the flexible plate is stretched straight restraining the first spring function, the one side being configured to be an outer surface when the flexible plate curves in the longitudinal direction of the flexible plate.

5. The pin holder wearable at the wrist according to claim 4, the flexible plate comprising a spring steel plate, a surface of the flexible plate being covered with a cover having flexibility.

6. The pin holder wearable at the wrist according to claim 4, the bottom portion of the casing being provided with a support plate, the support plate being spaced away from the bottom portion by a predetermined gap, the main body being configured to be supported by the band by inserting the band into between the support plate and the bottom portion, a dimension in a height direction of the band in the first form being greater than a distance between the support plate and the bottom portion, the height direction being perpendicular to both of a longitudinal direction and a width direction of the band.

* * * * *